United States Patent [19]

Schuurman

[11] Patent Number: 5,017,460

[45] Date of Patent: May 21, 1991

[54] METHOD OF MANUFACTURING A SHEAR PLATE FOR A DRY-SHAVER

[75] Inventor: Arend Schuurman, Drachten, Netherlands

[73] Assignee: U.S. Philips Corp., New York, N.Y.

[21] Appl. No.: 336,194

[22] Filed: Apr. 11, 1989

[30] Foreign Application Priority Data

Apr. 20, 1988 [NL] Netherlands ..... 8801017

[51] Int. Cl.[5] ..... G03C 5/00

[52] U.S. Cl. ..... 430/320; 430/323; 430/394; 30/346.51

[58] Field of Search ..... 430/320, 394, 323; 30/346.51

[56] References Cited

U.S. PATENT DOCUMENTS 3,179,543 4/1965 Marcelis ..... 30/346.51

FOREIGN PATENT DOCUMENTS 1511046 5/1978 United Kingdom .

*Primary Examiner*—Charles L. Bowers, Jr.
*Assistant Examiner*—Thorl Chea
*Attorney, Agent, or Firm*—Ernestine C. Bartlett

[57] ABSTRACT

The invention relates to a method of manufacturing a shear plate for a dry-shaver, which shear plate is formed with perforations, at least one side of a metal sheet being provided with a layer of a photosensitive material, which photosensitive material is exposed to radiation via a mask formed with a pattern of holes corresponding to the pattern of the perforations, after which the photosensitive material is developed and the perforations are formed in the metal sheet by etching. In accordance with the method a positive photosensitive material is used and in at least two stages at least two masks are employed, the method as defined above being carried out using a first mask and, subsequently, in the second stage using a second mask that part of the positive photosensitive material which was covered by the first mask being exposed to radiation, upon which said material is developed and the etching process is continued.

3 Claims, 3 Drawing Sheets

METHOD OF MANUFACTURING A SHEAR PLATE FOR A DRY-SHAVER

FIELD OF THE INVENTION

The invention relates to a method of manufacturing a shear plate for a dry-shaver, which shear plate is formed with perforations, at least one side of a metal sheet being provided with a layer of a photosensitive material, which photosensitive material is exposed to radiation via a mask formed with a pattern of holes corresponding to the pattern of the perforations, after which the photosensitive material is developed and the perforations are formed in the metal sheet by etching.

BACKGROUND OF THE INVENTION

Such a method is known, for example from U.S. Pat. No. 4,105,493. The method in accordance with said Patent further aims at improving the smoothness of the shear plate in that after the perforations have almost been formed the photosensitive layer is removed and the entire surface area of the shear plate at one side is subjected to a second etching operation.

For a close shave it is important that the shear plate is as thin as possible. However, a shear plate cannot be made arbitrarily thin if requirements such as those imposed on its strength and stiffness are to be met.

SUMMARY OF THE INVENTION

An object of the invention is to provide a simple method of manufacturing a shear plate which is locally, for example directly around the perforations, thinner than at other locations.

The method in accordance with the invention is characterized in that a positive photosensitive material is used and in that in at least two stages at least two masks are applied to one side of the sheet, the method as defined in the opening paragraph being carried out in the first stage using a first mask, after which in the second stage using a second mask that part of the positive photosensitive material which was covered by the first mask is exposed to radiation, upon which said material is developed and the etching process is continued.

Special embodiments of this method and products manufactured by means of the method for example may include the embodiment wherein the method is applied to both sides of the metal sheet or wherein the method is applied to side one and side two of the metal sheet is subjected to an etching process, side two being etched concurrently with the etching process in one of the stages of the method applied to side one, and, as part of the other one of said stages, the second side being masked during etching; or wherein the shear plate is formed with perforations adjoined by zones having a thickness smaller than the portions of the shear plate situated between the perforations; or wherein the shear plate has rows of elongate apertures, which rows terminate in channel-shaped recesses which extend in a direction transverse to the longitudinal direction of the perforations, and the channel-shaped recessed are separated by ridges.

BRIEF DESCRIPTION OF THE DRAWING

The invention will now be described in more detail, by way of example, with reference to the Figures.

DETAILED DESCRIPTION OF THE PREFERRED EMBODIMENTS

Figure 1:
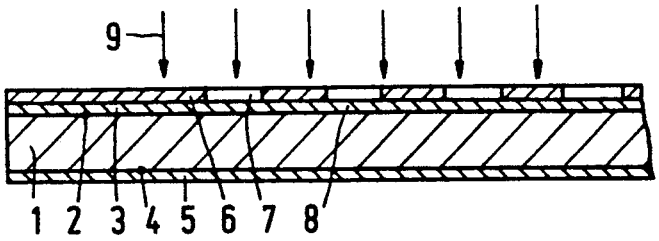
FIGS. 1 to 4 are sectional views of a metal plate with a photosensitive layer and, if applicable, a mask in order to illustrate a first embodiment of the method in different stages.
Figure 2:
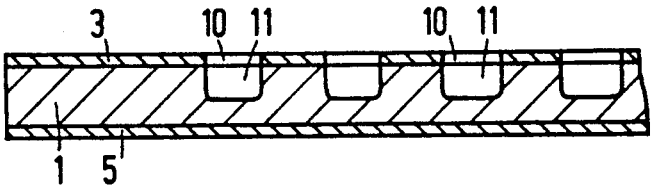

The method employs a flat metal sheet 1 on whose side 2 a layer 3 of a positive photosensitive material is deposited. If necessary, this layer is subjected to a thermal treatment. The other side 4 is covered with, for example, a protective layer 5 of adhesive tape. In a first stage a first mask 6 is arranged on the layer 3, which mask has a pattern of holes 7 corresponding to the pattern of perforations to be formed in the metal sheet 1. The portions 8 of the layer 3 which are not shielded by the mask 6 are exposed to ultraviolet radiation 9 (FIG. 1). Subsequently the mask 6 is removed and the photosensitive material at the location of the portions 8 is removed by developing and rinsing, causing the apertures 10 to be formed in the layer 3. If the side 2 of the metal sheet 1 is subsequently subjected to an etching process (for example spray-etching) the recesses 11 (FIG. 2) will be formed in the metal sheet 1 underneath the apertures 10.

Figure 3:
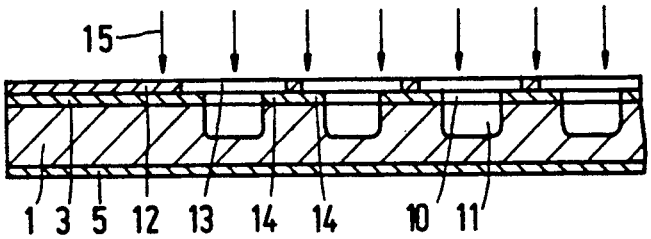
Figure 4:
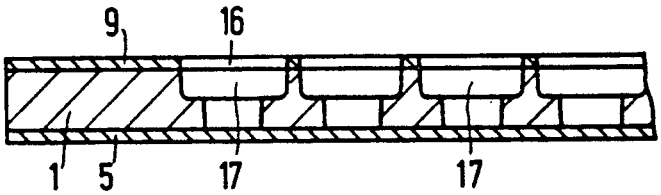

Subsequently, in a second stage, a second mask 12 having larger holes 13 is placed on the layer 3, so that portions 14 of the photosensitive layer 3 which were covered by the first mask 6 can now be exposed to ultraviolet radiation 15 (FIG. 3). After removal of the second mask 12 and developing and rinsing the apertures 10 in the layer 3 have become larger, resulting in the apertures 16 (FIG. 4). Subsequently, etching is continued until the recesses 11 shown in FIG. 2 have been enlarged to form the throughgoing perforations 17 in FIG. 4.

Figure 5:
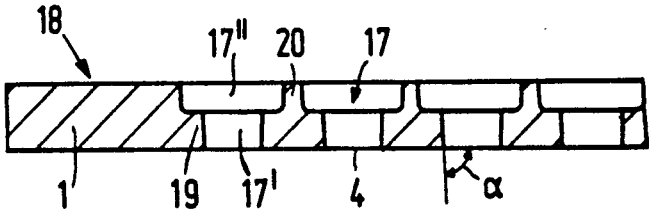
FIG. 5 is a sectional view taken on the line V—V in FIG. 6 and showing a shear plate manufactured by the method illustrated in FIGS. 1 to 4.
Figure 6:
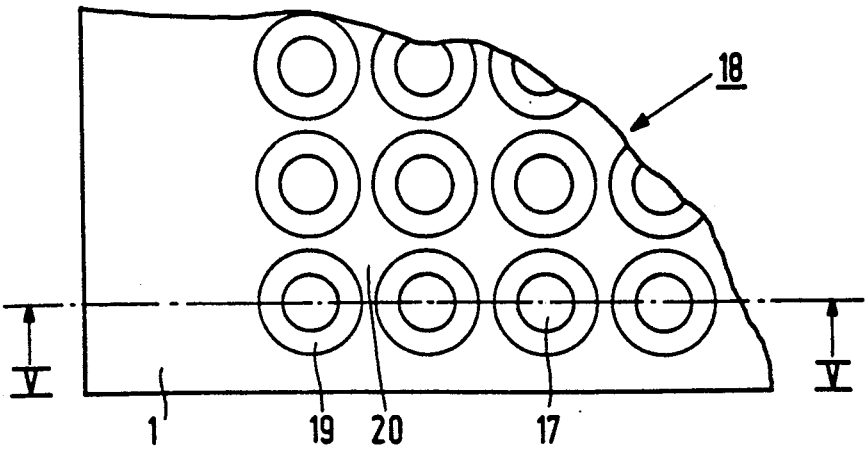
FIG. 6 is a plan view of the shear plate shown in FIG. 5, FIGS. 7 to 10, in the same way as FIGS. 1 to 4, illustrate a second embodiment of the method.

After removal of the residual portions of the layer 3 and the protective layer 5 the shear plate 18 as formed by the metal sheet 1 with the perforations 17 and as shown in FIGS. 5 and 6 is ready.

This two-stage manufacturing method using two different masks results in a special shape of the perforations 17 with portions 17' and 17'' of different diameters. The portion 17' is bounded by an annular shear-plate zone 19 of smaller thickness than the shear-plate zone 20 having the original thickness of the metal sheet.

When used in a shaving apparatus the shear plate 19 has an arcuate shape and its side 4 will engage against a drivable shaving member. The portion 20 then provides the required stiffness of the shear plate and the zones 19 of smaller thickness enable the hairs to be severed very close to the skin. The applied etching method enables the walls of the portions 17' of the perforations 17 to form an acute angle $\alpha$ (FIG. 5) with the side 4 of the shear plate, thereby providing optimum shaving results in cooperation with the drivable shaving member.

The above method is very suitable for the manufacture of such shear plates with zones of reduced thickness around the perforations. The use of the positive photosensitive material is essential in this method. The photosensitive material left on the metal sheet after the first stage is still unexposed and has consequently preserved its light-sensitive properties, enabling it to be used in the second stage. If desired, the method can be extended with a third stage using a third mask etc.

Instead of masks 6, 12 with holes 7 and 13 respectively other masks may be employed, for example photographic films with areas which are transparent and non-transparent to ultraviolet radiation.

In the above method the holes 7, 13 in the masks 6 and 12 respectively are circular but it will be appreciated that other shapes can be used.

Figure 7:
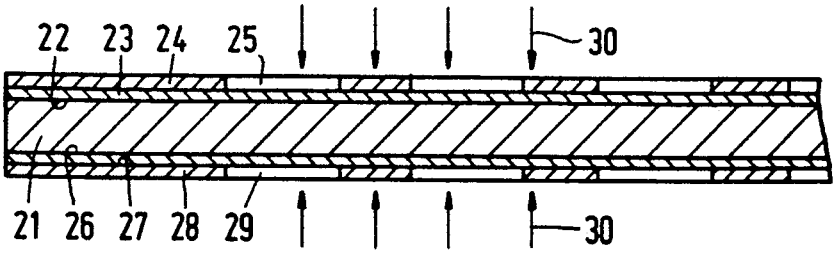
Figure 8:
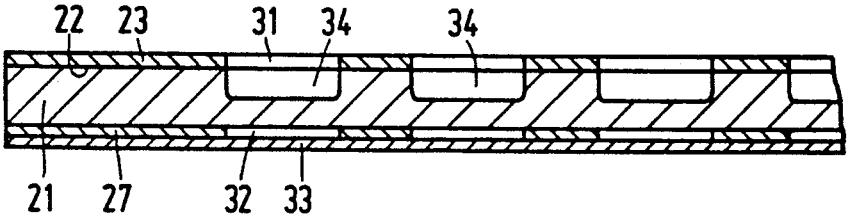

The method as illustrated in FIGS. 7 to 10 again employs a metal sheet 21 on whose side 22 a layer 23 of a positive photosensitive material is deposited. A mask 24 with holes 25 is placed on the layer 23. The side 26 of the metal sheet is also provided with a layer 27 of a positive photosensitive material on which a mask 28 is superposed, which mask has holes 29 corresponding to the holes 25 in the mask 24. Both sides of this assembly are exposed to ultraviolet radiation 30 (FIG. 7), as a result of which recesses 31 and 32 are formed in the layers 23 and 27 respectively (FIG. 8). Subsequently, the masks are removed and the photosensitive layers are covered with a protective layer 33. The first stage is completed by etching the sheet 21, as a result of which recesses 34 corresponding to the holes 25 are formed in the side 22.

Figure 9:
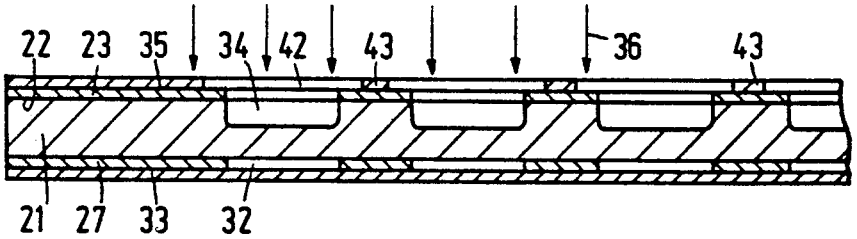
Figure 10:
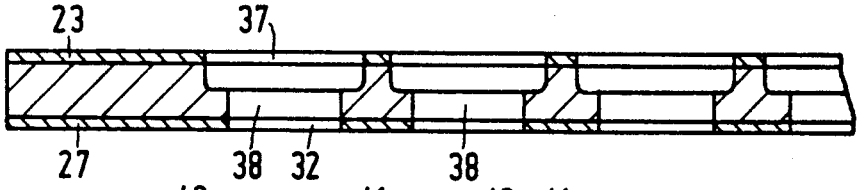
Figure 11:
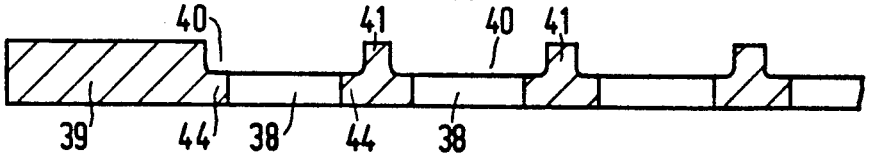
FIG. 11 is a sectional view taken on the line XI—XI in FIG. 12 and showing a shear plate manufactured by the method illustrated in FIGS. 7 to 10.
Figure 12:
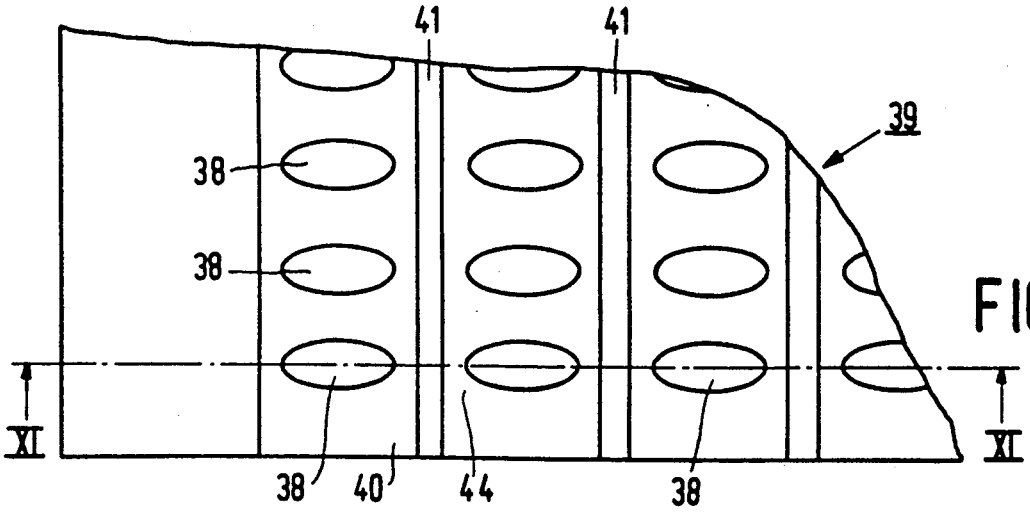
FIG. 12 is a plan view of the shear plate shown in FIG. 11.

In the second stage a second mask 35 is placed on the positive photosensitive layer 23 on the side 22, so that in the customary manner, inter alia by exposure to ultraviolet radiation 36 (FIG. 9), the recesses 31 in the layer 23 in FIG. 8 are enlarged to form the recesses 37 in FIG. 10. The protective layer 33 is removed and the metal sheet 21 is etched simultaneously at both sides to form the perforations 38. The shear plate 39 is ready after removal of residual portions of the layers 23 and 27. FIGS. 11 and 12 show a preferred embodiment of a shear plate 39 which can be manufactured by means of this method. In this shear plate a plurality of elongate perforations 38 arranged in a row terminate in a common channel-shaped recess 40. The recesses 40 are separated by ridges 41.

The masks 24 and 28 are then formed with holes 25 and 29 respectively whose shape corresponds to that of the perforations 38 in the shear plate 39. The mask 35 has elongate holes corresponding to the channel-shaped recesses and separated by strips 43 (FIG. 9).

Again the perforations 38 are surrounded by zones 44 of smaller thickness than the remainder of the shear plate. However, such a shear plate 39 can also be manufactured using a method as described with reference to FIGS. 1 to 4.

Figure 13:
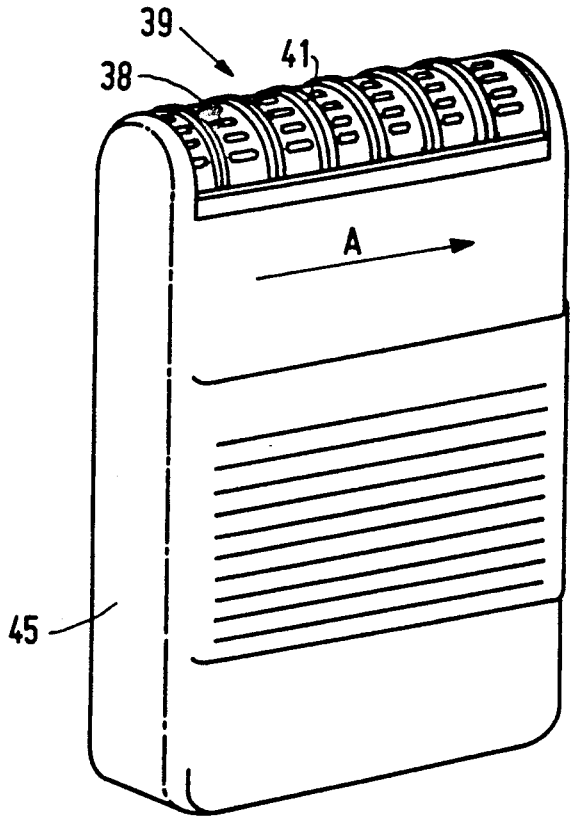
FIG. 13 is a perspective view of a shaver comprising, the shear plate shown in FIGS. 11 and 12.

The shear plate 39 as shown in FIGS. 11 and 12 can be employed, for example, in a shaver 45 as shown in FIG. 13, the shear plate being mounted in the shaver in arcuate form. The longitudinal directions of the elongate perforations 38 are oriented in the width direction (arrow A) of the shaver, the ridges 41 being curved in a direction transverse to this width direction. The ridges 41 again provide the required stiffness of the foil.

I claim:

1. A method of manufacturing a shear plate for a dry-shaver, which shear plate is formed with perforations in a multi-stage procedure wherein in each stage at least one side of a metal sheet is provided with a layer of a photosensitive material, which photosensitive material is exposed to radiation via a mask formed with a pattern of holes corresponding to the pattern of the perforations, after which the photosensitive material is developed and the perforations are formed in the metal sheet by etching, and wherein a positive photosensitive material is used and in at least two stages at least two masks are applied to one side of the sheet, the method being carried out in the first stage using a first mask, after which in the second stage using a second mask that part of the positive photosensitive material which was covered by the first mask is exposed to radiation, after which said material is developed and the etching process is continued.

2. A method as claimed in claim 1, wherein the procedure is applied to both sides of the metal sheet.

3. A method as claimed in claim 1, wherein the second side of the metal sheet is subjected to an etching process, the second side being etched concurrently with the etching process in one of the stages applied to the first side and, as part of the second stage, the second side being masked during etching.

* * * * *